US005080935A

United States Patent [19]

Kelso, Jr. et al.

[11] Patent Number: 5,080,935

[45] Date of Patent: Jan. 14, 1992

[54] PROCESS FOR POST-TREATMENT OF PRESERVATIVE-TREATED WOOD

[75] Inventors: William C. Kelso, Jr., Coldwater, Miss.; Richard W. Hein, Hudson, Ohio

[73] Assignee: Mooney Chemicals, Inc., Cleveland, Ohio

[21] Appl. No.: 607,587

[22] Filed: Nov. 1, 1990

[51] Int. Cl.[5] ..... B05D 3/04

[52] U.S. Cl. ..... 427/351; 427/297; 427/345; 427/397; 427/440; 34/16.5

[58] Field of Search ..... 427/297, 345, 351, 440, 427/393, 397; 34/13.8, 16.5, 60

[56] References Cited

U.S. PATENT DOCUMENTS

| | | | |
|---|---|---|---|
| 2,135,029 | 11/1938 | Boller | 427/345 |
| 2,135,030 | 11/1938 | Boller | 427/345 |
| 2,668,779 | 2/1954 | Herman | 427/297 |
| 2,860,070 | 11/1958 | McDonald | 427/297 |
| 3,094,431 | 6/1963 | Goldstein et al. | 427/345 |
| 3,200.003 | 8/1965 | Bescher | 427/297 |
| 3,677,805 | 1/1972 | Barnett, Jr. | 427/345 |
| 3,685,959 | 8/1972 | Dunn, Jr. et al. | 427/397 |
| 3,785,770 | 1/1974 | Hudson | 427/297 |
| 3,874,908 | 4/1975 | Liddell | 427/345 |
| 3,959,529 | 5/1976 | Winn et al. | 427/351 |
| 3,968,276 | 7/1976 | Allen | 427/297 |
| 3,985,921 | 10/1976 | Rowell et al. | 427/397 |
| 4,548,839 | 10/1985 | Moldrup et al. | 427/345 |
| 4,649,065 | 3/1987 | Hein et al. | 427/370 |
| 4,783,221 | 11/1988 | Grove | 106/18.22 |

*Primary Examiner*—Shrive Beck
*Assistant Examiner*—Terry J. Owens
*Attorney, Agent, or Firm*—Renner, Otto, Boisselle & Sklar

[57] ABSTRACT

Oil-borne preservative-impregnated wood is post-treated by:

(A) contacting the preservative-impregnated wood in a closed vessel with steam and collecting a water-containing condensate generated in the vessel;

(B) applying a vacuum which is sufficient to reflux water condensate to remove at least some surface deposits from the wood and to distill water out of the vessel leaving an oil-preservative solution in the vessel;

(C) releasing the vacuum; and (D) recovering the post-treated wood from the vessel.

16 Claims, No Drawings

PROCESS FOR POST-TREATMENT OF PRESERVATIVE-TREATED WOOD

FIELD OF THE INVENTION

The present invention relates to a process for post-treating freshly preserved wood. More particularly, the process of the present invention involves a sequence of steps using steam or water under a vacuum to provide a cleaner surface on treated wood.

BACKGROUND OF THE INVENTION

In order to prevent decay of wood and timbers, and thereby increasing their life, it is common practice to impregnate the wood or timbers with a preservative such as creosote, mixtures of inorganic compounds dissolved or dispersed in water, or certain organic or metallo-organic compounds which are dissolved in organic solvents. The protection afforded by the application of these materials is dependent upon deep and reasonably uniform penetration into the wood or timber by the preservative material while at the same time leaving a clean surface on the wood-treated product.

The subject of wood treatment and wood preservation is discussed in some detail in the two volume treatise entitled "Wood Deterioration and its Prevention by Preservative Treatments", Darrel D. Nicholas, Editor, Syracuse Wood Science Series 5, Syracuse University Press, Syracuse, N.Y., 1973. Among the examples of wood preservatives described therein are various creosote compositions, pentachlorophenol, copper naphthenate, copper-8-quinolinolate, organotin compounds, organomercury compounds, zinc naphthenate, chlorinated hydrocarbons, ammoniacal copper arsenate (ACA) acid copper chromate (ACC), zinc salts such as zinc chloride, zinc oxide and zinc sulfate, chromated copper arsenate (CCA), etc.

Processes and equipment for treating wood are discussed in Volume II, Chapter 3, pages 279–298. The pressure treatment is described as the most effective method of protecting wood against attack of decay, insects, fire, etc. Non-pressure treatments also are discussed in this chapter. Dipping is suggested primarily as a satisfactory surface treatment although some penetration is observed. Another non-pressure technique is the diffusion process with unseasoned wood. The author indicates the process requires long treating periods because of sloe diffusion rates. Water-solution preservatives are required.

It also has been suggested to improve the method of pressure treatment by first subjecting the wood to a vacuum treatment. Examples of prior art patents describing methods of impregnating wood utilizing a vacuum followed by pressure include U.S. Pat. Nos. 2,668,779; 3,200,003; and 3,968,276.

U.S. Pat. No. 3,677,805 describes a modification of the pressure treatment. In this procedure, the wood is immersed in a treatment liquid inside a pressure vessel, and the pressure is increased to operating pressure whereupon the contents of the vessel then are subjected to the action of a pulsating pump which provides sinusoidal pressure pulses within the vessel. In other words, pressure pulses are applied repetitively in modulated amplitude to provide variable pressure peaks above and below the ambient pressure maintained in the pressure vessel. This procedure requires equipment which includes a pulsating pump operating into a pressure vehicle equipped with a pressure release means.

As mentioned above, the most common commercial procedure for impregnating wood involves subjecting the wood to the preservative under relatively high pressures and sometimes at relatively high temperatures. Normally, the procedure involves placing the wood in a vessel, filling the vessel with the preservative mixture and raising the pressure within the vessel to the desired level to effect penetration of the solution into the wood. Sometimes, the temperature of the liquid within the vessel is raised to an elevated temperature. After the wood has been subjected to the penetrating system for the desired period of time, the pressure is reduced, generally, to atmospheric pressure, and as the pressure is reduced, some of the penetrating solution contained in the wood is forced out of the wood by expansion of the air within the wood as the external pressure is reduced. This penetrating solution which is released and recovered from the wood as the external pressure is reduced is generally referred to in the art as "kickback". When the term is used in this application, it shall have the same meaning.

Sometimes, especially with oil-borne preservatives, before the wood is removed from the vessel, it is subjected to a "post-treatment" to recover additional kickback, or to clean the surface of the final treated product and/or to improve the color of the treated product. Known post-treating procedures include a live steaming process which comprises the steps of introducing live steam into the vessel containing the wood at about 0–10 psig, removing the oily condensate that is formed, applying a vacuum, and finally removing the oil and water vacuum drippings. In another steaming process referred to in the industry as "closed steaming", a large amount of water (at least enough to cover the internal heating coils) is added to the vessel, and the water is heated to the boiling temperature at about 0–10 psig. The hot water is then removed, and a vacuum is applied. Following the vacuum, the vessel is vented to atmospheric pressure and the vacuum drippings of oil and water are removed. In another post-treatment which has been utilized commercially ("vapor drying"), a hydrocarbon or other suitable solvent is added to the vessel containing the wood and the solvent is heated to boiling at an appropriate temperature and pressure. Subsequently, the solvent is removed; a vacuum is applied; and finally the vessel is vented to atmospheric pressure, and the vacuum drippings of the solution of oil-borne preservative in the solvent are removed. In another process referred to as the "expansion bath" process, the preservative-treated wood and the preservative solution are heated to a temperature higher than the temperature used when the pressure was applied to the wood in the presence of the preservative. Generally, this higher temperature is about 210°–220° F., and the temperature is maintained for a given period following which the preservative solution is removed, and a final vacuum is applied to generate additional kickback following which the wood is removed from the vessel.

Some of these post-treatment procedures usually yield kickback as a result of the increase in the temperature. These include the live steaming, closed steaming and expansion bath procedures. The final post-treatment vacuum also normally yields kickback by decreasing the pressure. The vapor drying process obviously requires special procedures and equipment to handle the organic solvents and to prevent fires. In the two steaming post-treatments, an oily water mixture is produced that requires additional special handling.

The above-described prior art represents a sampling of the suggestions which have been made for producing clean treated wood that is dry to the touch when oil-borne preservatives are used. In spite of the many techniques in the prior art, there continues to be a need for a less expensive, safe post-treatment that results in a cleaner surface.

SUMMARY OF THE INVENTION

An improved process for the post-treatment of oil-borne preservative-treated wood is described. More particularly, the improved process comprises, in one embodiment, the steps of (A) contacting the preservative-impregnated wood in a closed vessel with steam and collecting the water condensate that is generated in the vessel;

(B) applying a vacuum which is sufficient to allow refluxing of the water condensate to remove at least some surface deposits and distillation of the water out of the vessel leaving an oil-preservative solution in the vessel;

(C) releasing the vacuum; and (D) recovering the post-treated wood from the vessel.

The invention uses a method of steam-cleaning that requires less time, less water and lower temperatures, and the method results in a simultaneous separation of the steam condensate from the oil-preservative solution.

DESCRIPTION OF THE PREFERRED EMBODIMENTS

The present invention is an improved process for the post-treatment of oil-borne preservative-treated wood using refluxing water or steam, under vacuum. The improved process uses a sequence of steps to steam-clean the preservative impregnated wood to provide a clean and dry surface.

More specifically, in one embodiment, the improved process of the present invention comprises the steps of (A) contacting the oil-borne preservative-impregnated wood in a closed vessel with steam and collecting a water condensate that is generated in the vessel;

(B) applying a vacuum which is sufficient to allow refluxing of the water condensate to remove at least some surface deposits while distilling water out of the vessel and leaving an oil-borne preservative solution in the vessel;

(C) releasing the vacuum;

(D) removing the oil-borne preservative solution from the vessel; and (E) recovering the post-treated wood from the vessel.

It has now been found that improved post-treatment of preserved wood is obtained by the process of the present invention resulting in a cleaner and/or lighter colored wood surface.

Wood which has been impregnated with various preservative liquids, and, in particular, hydrocarbon- or oil-borne preservatives can be post-treated in accordance with the process of the present invention to provide wood surfaces which are cleaner and lighter in color than impregnated wood which has not been subjected to a post-treatment process.

The preservative-impregnated wood which can post-treated in accordance with the present invention may be air-seasoned or kiln-dried wood which has been impregnated with one or more of a variety of known preservatives dissolved in a solvent or dispersed in a diluent. The preservatives may be applied to the wood as solutions, emulsions or micro-emulsions. In one embodiment, the preservative solutions are solutions comprising metal salts of organic carboxylic acids such as described in U.S. Pat. No. 4,649,065 (Hein et al) and U.S. Pat. No. 4,783,221 (Grove). The disclosures of these two patents are hereby incorporated by reference for their description of preservative solutions which can be utilized for treating wood.

In one preferred embodiment, the post-treatment process of the present invention is applied to wood which has been impregnated with solutions of preservatives in suitable solvents such as hydrocarbon solvents. Examples of hydrocarbon solvents include aromatic as well as aliphatic solvents, and mixtures of aromatic and aliphatic solvents. Specific examples of hydrocarbon solvents include mineral spirits, naphtha, light mineral oil, xylene, toluene, and commercial mixtures of hydrocarbon solvents such as petroleum hydrocarbons. Oxygenated hydrocarbons such as alcohols, ketones, ethers and esters are also useful as solvents. Examples of specific hydrocarbon solvents which are useful include solvents that are principally aliphatic such as No. 2 diesel fuel, Pennzoil 510 oil and solvents which are principally aromatic such as Shell P9A oil and Lilyblad Base L oil.

A variety of preservative-impregnated wood types can be post-treated in accordance with the present invention. Examples of wood species which can be treated in accordance with the present invention include Southern Yellow Pine, Western Red Cedar, Douglas fir, Lodgepokle pine, Jack pine, Red pine, Ponderosa pine, etc.

In another embodiment, the impregnated wood which is subjected to the post-treatment process of the present invention is wood which has been impregnated with a hydrocarbon- or oil-borne preservative in an empty-cell process (either Rueping or Lowry). In the empty-cell process, dried wood is loaded into a vessel or retort and an initial air pressure is applied. The pressure generally is about 0 psig for the Lowry process and is typically about 20–40 psig for the Rueping process. The vessel is then filled at the initial air pressure with the oil solution of the preservative, and the pressure and temperature are increased to appropriate values such as 100–150 psig and 150°–200° F. The temperature and pressure are maintained for a period of time to achieve an appropriate penetration and retention of the preservative in the wood. The pressure is then released and after venting to atmospheric pressure, the preservative solution is removed from the vessel. A vacuum is applied to the wood in the vessel and maintained for an appropriate time to produce the "vacuum drip". After an appropriate time, the vacuum is released and the vessel vented to atmospheric pressure. The drippings formed during the vacuum step are removed from the vessel, and the wood is now in condition for the post-treatment process of the present invention.

In the first step of one embodiment of the post-treating process of the present invention, live steam is added to the closed vessel which contains the preservative impregnated wood. The present invention differs from the prior procedures in that the amount of steam added to the vessel is reduced. The term "live steam" is used in this specification and claims to refer to steam which is introduced into the vessel from an external source as distinguished from steam generated in situ by heating water contained in the vessel.

In one preferred embodiment, the steam is added to the vessel while the vessel and the wood contained therein are still warm from the impregnation process. Generally, the temperature of the vessel and the wood contained in the vessel will be in the range of from 150° F. to 200° F. The steam is added to the closed vessel at about 0–10 psig and the temperature of the live steam added to the closed vessel is about 225°–240° F. A water condensate collects in the closed vessel during this step.

The next step of the post-treating process of the present invention is the application of a vacuum within the vessel containing the wood and water condensate. The vacuum should be sufficient to allow refluxing and distillation of the water condensate, generally without any additional source of heat, for a period of time sufficient to remove some of the surface deposits on the impregnated wood and essentially all of the water in the vessel. This period of time may vary depending upon the temperature, the vacuum, and the amount of water to be removed. Accordingly, the refluxing and distillation of the water condensate in the vessel may be maintained for a period of from about 10 minutes to about 2 hours, but generally, a period of from about 20 minutes to about 60 minutes is sufficient.

The vacuum within the vessel during this step may be varied over a wide range. A vacuum of from about 10 to about 24 inches of mercury is particularly useful. A high vacuum should be avoided since little or no refluxing of the water will occur. In another embodiment, a vacuum (in inches of mercury) of from 10 to about 20 is useful, and at these vacuums, the boiling point of water is from 192° F. to 160° F., respectively.

When the impregnated wood has been subjected to the vacuum and refluxing water treatment for the desired period of time, that is, after all of the water is distilled out of the vessel leaving an oil-preservative solution in the vessel, the vacuum is released. The post-treated wood then can be removed from the vessel. Generally the oil-preservative solution is removed from the vessel before the wood is recovered.

One of the advantages of the present invention is that the process requires only a small amount of steam (or water) relative to prior processes. Another advantage of the present invention is that the water which is removed in the post-treatment can be recovered and used, or easily disposed since it is a clean distilled water.

In another embodiment of the post-treating process of the present invention, the first step involves adding hot water, preferably at about 150°- 200° F., to a vessel containing the preservative impregnated wood rather than steam as described above. Generally, the water is added to the vessel while the vessel and wood contained therein are still warm from the impregnation process. The addition of small amounts of water, e.g., less than a few percent of the volume of the vessel is one advantage of the process of the invention.

In the next step a vacuum is applied to allow the water in the vessel to reflux and to distill from the vessel as in the steam embodiment described above. The remaining steps in this embodiment are similar to the preferred process wherein steam is added in a first step to a closed vessel containing the oil-borne preservative-impregnated wood.

The following examples illustrate the post-treatment process of the present invention. Unless otherwise specifically indicated in the following examples and elsewhere in the specification and claims, all parts and percentages are by weight, and all temperatures are in degrees Fahrenheit.

EXAMPLE 1

Preservative Treatment Process

Previously peeled and dried Southern Yellow Pine poles are loaded into an autoclave (retort) or treating cylinder suitable for treating wood with oil-borne preservatives according to American Wood Preservative Association (AWPA) standards. The cylinder door is closed, and 30 psig of initial air pressure is applied. The cylinder is then filled with an oil solution of the preservative (e.g., copper naphthenate) while maintaining a constant pressure of 30 psig. When the cylinder is full, the pressure is increased to 170 psig, and the temperature is raised to about 160° F. These conditions are maintained for one hour whereupon the pressure is released and the cylinder is vented to atmospheric pressure. The preservative solution is removed from the cylinder, and a vacuum of 24 inches of mercury is applied for 60 minutes. The vacuum within the vessel is then released and vented to atmospheric pressure. The drippings from the vacuum treatment are pumped out of the cylinder.

Post-Treatment

Live steam (about 230° F.) is added to the closed cylinder containing the above-treated wood at 6 psig for about 30 minutes while collecting the steam condensate in the cylinder. At this time steam is no longer added to the closed cylinder, but a vacuum of about 18 inches of mercury is applied initially. Thereafter the vacuum is increased slowly so that the water from the condensed steam contained in the vessel refluxes on the wood poles and distills from the vessel. The vacuum is increased to about 22 inches of mercury over a period of about 40 minutes. When essentially all of the water has been distilled from the vessel, the vacuum is released, and the vessel is vented to atmospheric pressure. The residual oil-preservative solution is removed from the cylinder followed by removal of the post-treated wood. The pine poles treated in this manner are characterized as having a cleaner, drier and lighter colored surface than the poles which are obtained if the post-treatment is omitted and the impregnated poles are only subjected to a final vacuum.

EXAMPLE 2

Preservative Impregnation Process

Southern Yellow Pine poles are treated in accordance with the same process as described above in Example 1.

Post-Treatment

While the cylinder and treated wood within the cylinder are at about 160° F., about 200 to 300 gallons of water at about 180° F. are added to the vessel. (The empty volume of the vessel is about 32,000 gallons.) A vacuum is then applied which is sufficient to cause the water to reflux within the vessel on the treated wood and to distill from the vessel. At a vacuum of about 20 inches of mercury, the refluxing temperature of the water within the vessel is about 160° F. The vacuum is maintained at a range of from 16 to 22 inches of mercury for about 55 minutes or until all of the water in the vessel is removed from distillation. The vacuum is then released and the vessel vented to atmospheric pressure.

The post-treated wood is then removed from the vessel. The impregnated wood post-treated in this manner has a clean surface, light color, and is dry to the touch which results in handling advantages.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. An improved process for impregnating wood with oil-borne preservative solution in an impregnating vessel, wherein the improvement comprises subjecting the freshly preservative-impregnated wood to a post-treatment after the preservative solution and vacuum drip are removed from the impregnating vessel, said post-treatment comprising the steps of:

(A) contacting the oil-borne preservative-impregnated wood in a closed vessel with steam and collecting a water-containing condensate in the vessel;

(B) applying a vacuum which is sufficient to reflux water condensate to remove at least some surface deposits from the wood and to distill water out of the vessel leaving an oil-preservative solution in the vessel;

(C) releasing the vacuum; and (D) recovering the post-treated wood from the vessel.

2. The process of claim 1 wherein the oil-preservative solution remaining in the vessel after step (C) is removed from the vessel before the wood is recovered in step (D).

3. The process of claim 1 wherein the vessel used in step (A) is the same vessel used for preservative impregnation of the wood.

4. The process of claim 1 wherein the pressure within the closed vessel in step (A) is about 0 psig to about 10 psig.

5. The process of claim 1 wherein the temperature of the steam in step (A) is about 225°–240° F.

6. The process of claim 1 wherein the time for step (B) is from about 20 minutes to about 60 minutes.

7. An improved process for impregnating wood with oil-borne preservative solution in an impregnating vessel, wherein the improvement comprises subjecting freshly preservative-impregnated wood to a post-treatment after the preservative solution and vacuum drip are removed from the impregnating vessel, said post-treatment comprising the steps of:

(A) contacting the oil-borne preservative-impregnated wood in a closed vessel with steam, at a temperature of about 225°–240° F. at 0 to 10 psig while collecting a water-containing condensate in the vessel;

(B) applying a vacuum of about 10 to about 24 inches of mercury, which is sufficient to reflux water condensate to remove at least some surface deposits from the wood and to distill water out of the vessel leaving an oil-preservative solution in the vessel;

(C) releasing the vacuum;

(D) removing the oil-preservative solution from the vessel; and (E) recovering the post-treated wood from the vessel.

8. The process of claim 7 wherein essentially all of the water condensate in the vessel is removed by distillation under vacuum in step (B).

9. The process of claim 7 wherein he vacuum is maintained in step (B) for a period of from about 20 to about 60 minutes.

10. The process of claim 7 wherein the oil-preservative solution recovered in step (D) is used to impregnate wood.

11. An improved process for impregnating wood with oil-borne preservative solution in an impregnation vessel, wherein the improvement comprises subjecting the preservative-impregnated wood to a post-treatment after the preservative solution and vacuum drip are removed from the impregnating vessel, said post-treatment comprising the steps of:

(A) adding hot water to the vessel in which is contained the preservative-impregnated wood;

(B) applying a vacuum which is sufficient to reflux water to remove at least some surface deposits from the wood and to distill water out of the vessel leaving an oil-preservative solution in the vessel;

(C) releasing the vacuum; and (D) recovering the post-treated wood from the vessel.

12. The process of claim 11 wherein the oil-preservative solution in the vessel after step (C) is removed from the vessel before the wood is recovered in step (D).

13. The process of claim 11 wherein the vessel used in step (A) is the same vessel used for preservative impregnation of the wood.

14. The process of claim 11 wherein the wood is at an elevated temperature from the preservative treatment when contacted with water in step (A).

15. The process of claim 11 wherein the hot water in step (A) is water recovered from previous post-treatment.

16. The process of claim 11 wherein the vacuum in step (B) is from about 10 to about 26 inches of mercury.

* * * * *